US009395674B2

(12) United States Patent
Murooka

(10) Patent No.: US 9,395,674 B2
(45) Date of Patent: Jul. 19, 2016

(54) CURL CORRECTION APPARATUS, SHEET CONVEYING APPARATUS, AND IMAGE FORMING APPARATUS

(71) Applicant: CANON KABUSHIKI KAISHA, Tokyo (JP)

(72) Inventor: Ken Murooka, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/146,062

(22) Filed: Jan. 2, 2014

(65) Prior Publication Data

US 2014/0219697 A1 Aug. 7, 2014

(30) Foreign Application Priority Data

Feb. 7, 2013 (JP) ..... 2013-022529

(51) Int. Cl.
*G03G 15/00* (2006.01)

(52) U.S. Cl.
CPC .. *G03G 15/6576* (2013.01); *B65H 2301/51256* (2013.01); *B65H 2404/6942* (2013.01)

(58) Field of Classification Search
CPC ..... G03G 15/6576; G03G 2215/00662; G03G 2215/00704; B41J 11/0005; B65H 29/70; B65H 2301/51256; B65H 2301/512565; B65H 2601/254; B65H 2404/694; B65H 2404/6942; B65H 2404/74; B65H 2404/743
See application file for complete search history.

(56) References Cited

U.S. PATENT DOCUMENTS

| | | | | |
|---|---|---|---|---|
| 4,505,695 | A * | 3/1985 | Billings | B65H 5/36 162/271 |
| 5,290,021 | A | 3/1994 | Murooka et al. | |
| 5,537,195 | A | 7/1996 | Sagara et al. | |
| 5,761,574 | A | 6/1998 | Murooka | |
| 6,415,130 | B1 * | 7/2002 | Fujiwara et al. | 399/401 |
| 6,619,657 | B2 * | 9/2003 | Horikoshi et al. | 271/188 |
| 7,828,281 | B2 * | 11/2010 | Terao | B65H 29/52 271/271 |
| 2006/0216075 | A1 * | 9/2006 | Sugawara et al. | 399/316 |
| 2008/0095546 | A1 * | 4/2008 | Abe | G03G 15/2028 399/21 |
| 2010/0150635 | A1 * | 6/2010 | Tanaka et al. | 399/406 |
| 2014/0126945 | A1 | 5/2014 | Uchida et al. | |

FOREIGN PATENT DOCUMENTS

| | | | | |
|---|---|---|---|---|
| JP | 08225221 A | * | 9/1996 | B65H 29/70 |
| JP | 2005-255288 A | | 9/2005 | |
| JP | 4095567 B2 | | 6/2008 | |

* cited by examiner

*Primary Examiner* — Justin Olamit
(74) *Attorney, Agent, or Firm* — Fitzpatrick, Cella, Harper & Scinto

(57) ABSTRACT

A curl correction apparatus that corrects a curl of a sheet includes: a hard roller that is disposed in the downstream in a sheet conveying direction of a heating apparatus; a soft roller that is disposed in the downstream in the sheet conveying direction of the heating apparatus; and a guide member that is disposed in the immediate upstream in the sheet conveying direction with respect to the hard roller, and guides the sheet; wherein a nip width in the sheet conveying direction of a nip portion between the hard roller and the soft roller is set to be narrower in a central portion in an axial direction than end portions in the axial direction, and the guide member is configured to protrude in the central portion in the axial direction toward the downstream in the sheet conveying direction from the both end portions in the axial direction.

22 Claims, 9 Drawing Sheets

CURL CORRECTION APPARATUS, SHEET CONVEYING APPARATUS, AND IMAGE FORMING APPARATUS

BACKGROUND OF THE INVENTION

1. Field of the Invention

The present invention relates to a curl correction apparatus that corrects a curl of a sheet, a sheet conveying apparatus including the same, and an image forming apparatus including the same.

2. Description of the Related Art

Japanese Patent Laid-Open No. 2005-255288 discloses a curl correction apparatus that is disposed in the immediate downstream in a sheet conveying direction with respect to a fixing apparatus, includes a hard roller, and a soft roller pressed against the hard roller, and corrects the curl of the sheet at a nip between the rollers. At the nip between the hard roller and the soft roller, an image fixing surface of the sheet on which a toner image is fixed hits on a peripheral surface of the hard roller, and a back surface thereof hits on a peripheral surface of the soft roller. Although the sheet is deformed to an upper curl (a curl in which the sheet has a convex shape toward the lower side) toward the image fixing surface by the fixing apparatus, the upper curl of the sheet is corrected in the process of passing through the nip between the hard roller and the soft roller.

Furthermore, in the invention described in Japanese Patent Laid-Open No. 2005-255288, the nip is formed in such a manner that the hard roller bites into the soft roller by bringing the bearings of both end portions of the soft roller into contact with the bearings of both end portions of the hard roller. In this case, the hard roller and the soft roller are bent by the reaction force at the nip portion, and the axial distance between the central portions in an axial direction (a longitudinal direction) thereof increases compared with both end portions. For this reason, in the hard roller and the soft roller, a biting force between both end portions in the axial direction is large, but the biting force in central portion in the axial direction becomes smaller. In order to back up the biting force in the central portion in the axial direction by reducing a difference in the balance of the biting force, a backup roller is disposed toward the hard roller, and the backup roller applies a force to the soft roller by pressing the central portion in the axial direction of the hard roller.

However, in the configuration using the backup roller, unfixed toner attached to the hard roller may move to the backup roller and may be gradually accumulated. Moreover, the unfixed toner accumulated on the backup roller may move to the hard roller at a time to cause image failure on the sheet. Furthermore, in the hard roller, a portion hitting on the backup roller, and a portion that does not hit thereon are generated to make a temperature difference between the hitting portion and the non-hitting portion, thereby causing unevenness in the image fixed to the sheet.

SUMMARY OF THE INVENTION

It is desirable to provide a curl correction apparatus capable of reducing image failure and unevenness occurring in the sheet by a configuration including a hard roller and a soft roller that correct the curl in the immediate downstream in the sheet conveying direction with respect to the fixing apparatus.

A curl correction apparatus that corrects a curl of a sheet, the apparatus comprising: a hard roller that is disposed in a downstream in a sheet conveying direction of a heating apparatus configured to heat a sheet having a toner image and is formed of a hard material; a soft roller that is disposed in the downstream in the sheet conveying direction of the heating apparatus, is formed of a soft material having hardness lower than that of the hard roller; and a guide member that is disposed in an immediate upstream in the sheet conveying direction with respect to the hard roller, and guides the sheet; wherein a nip width in a sheet conveying direction of a nip portion between the hard roller and the soft roller is set to be narrower in a central portion in an axial direction than both end portions in the axial direction, and the guide member is configured to protrude in the central portion in the axial direction toward the downstream in the sheet conveying direction from the both end portions in the axial direction.

Further features of the present invention will become apparent from the following description of exemplary embodiments with reference to the attached drawings.

DESCRIPTION OF THE EMBODIMENTS

First Embodiment

Figure 1:
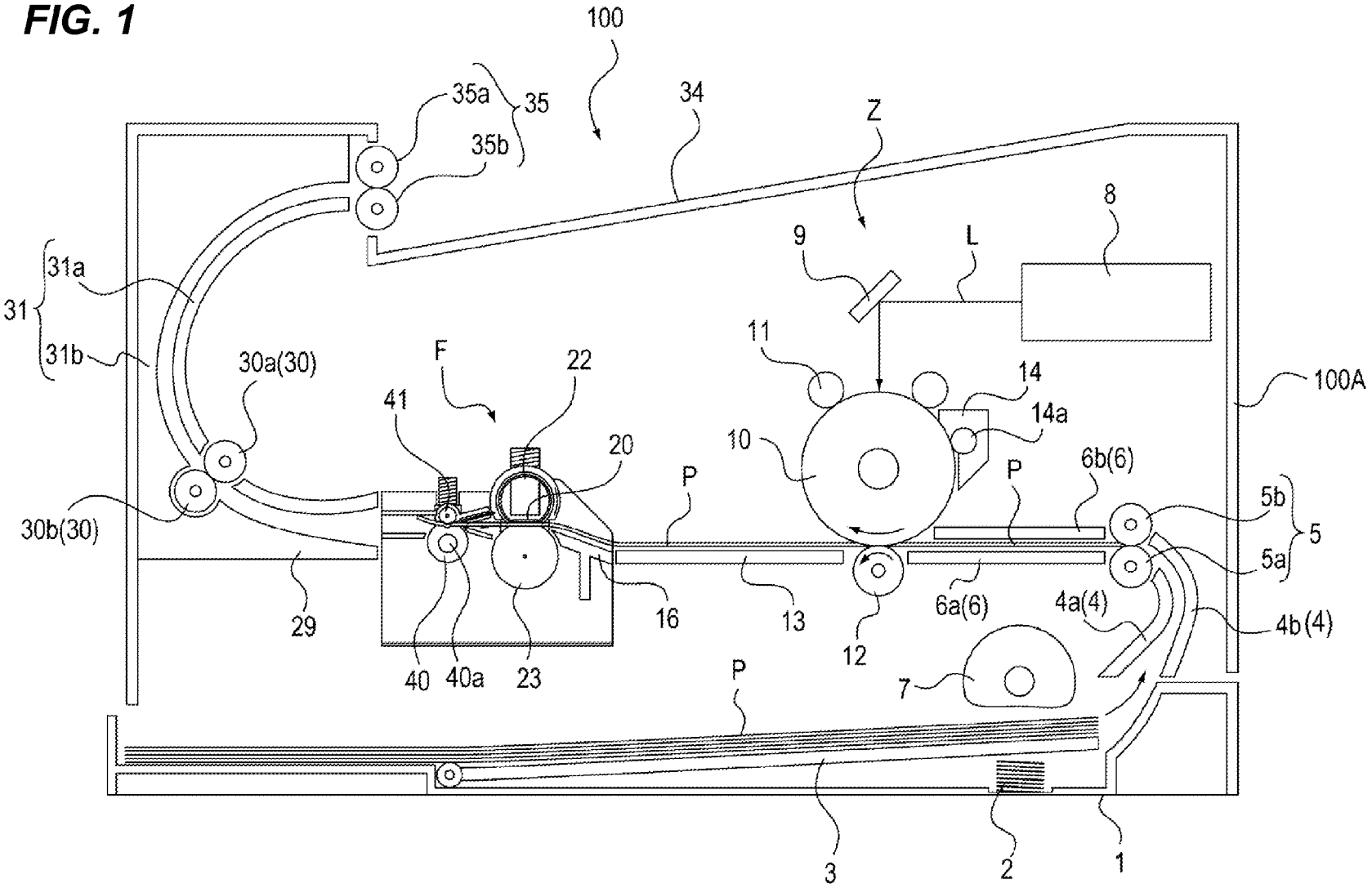
FIG. 1 is a cross-sectional view of an image forming apparatus.

FIG. 1 is a cross-sectional view of an image forming apparatus 100. The image forming apparatus 100 has an apparatus main body 100A. A photosensitive drum 10 is disposed inside the apparatus main body 100A. A charging roller 11, an exposure apparatus 8, a developing apparatus 14, and a transfer roller 12 are disposed around the photosensitive drum 10. The photosensitive drum 10 rotates at a predetermined process speed in a direction indicated by an arrow by the driving force of a driving motor (not illustrated) disposed inside the apparatus main body 100A. For example, the predetermined process speed is set to 250 mm/sec. The exposure apparatus 8 is a laser scanner, and reflects an output laser L by a turn-back mirror 9 to reach the photosensitive drum 10. An image forming portion Z configured to form an image on a sheet P is provided with an image forming device such as the photosensitive drum 10, and a fixing unit portion Fa which will be described later.

Furthermore, a cassette 1 is disposed inside the apparatus main body 100A at a lower position. The cassette houses the sheet P (a sheet, a printing sheet, a form sheet, an OHT sheet, a glossy sheet, a glossy film or the like). Furthermore, a feeding roller 7, a conveying guide 4, a pair of conveying rollers 5, a conveying guide 6, the photosensitive drum 10, the transfer roller 12, a conveying guide 13, a fixing unit portion Fa, and a curl correction portion Fb are sequentially disposed along the conveying path of the sheet P. Furthermore, an outlet lower guide 29, a pair of guide rollers 30, a guide 31, a pair of discharge rollers 35, and a discharge tray 34 are continuously disposed. In addition, the fixing unit portion Fa and the curl correction portion Fb may also be unitized as illustrated in FIG. 1, or may be separate bodies.

The photosensitive drum 10 is uniformly charged by the charging roller 11, an electrostatic image is formed by the exposure apparatus 8, the electrostatic image is developed with toner by the developing apparatus 14, and a toner image is formed.

Meanwhile, the sheet P is fed from the cassette 1 by the feeding roller 7 one by one, and is conveyed to a transfer nip portion between the photosensitive drum 10 and the transfer roller 12 through the conveying guides 4*a* and 4*b*, the pair of conveying rollers 5*a* and 5*b*, and the conveying guides 6*a* and 6*b*. At this time, a leading end of the sheet P is detected by a top sensor (not illustrated), and the sheet P is synchronized with the toner image on the photosensitive drum 10. Transfer bias is applied to the transfer roller 12, and the toner image on the photosensitive drum 10 is transferred to a predetermined position on the sheet P in the transfer nip portion.

The sheet P, which an unfixed toner image is transferred to, is guided by the conveying guide 13, and is conveyed to the fixing unit portion Fa and the curl correction portion Fb. The fixing unit portion Fa as a heating apparatus fixes the unfixed toner image onto the sheet P. Thereafter, the sheet P is discharged to the discharge tray 34 by the outlet lower guide 29, the pair of guide rollers 30, the guide 31, and the pair of discharge rollers 35. The above operations are repeated, and the image formation is successively performed on the sheet.

Figure 2:
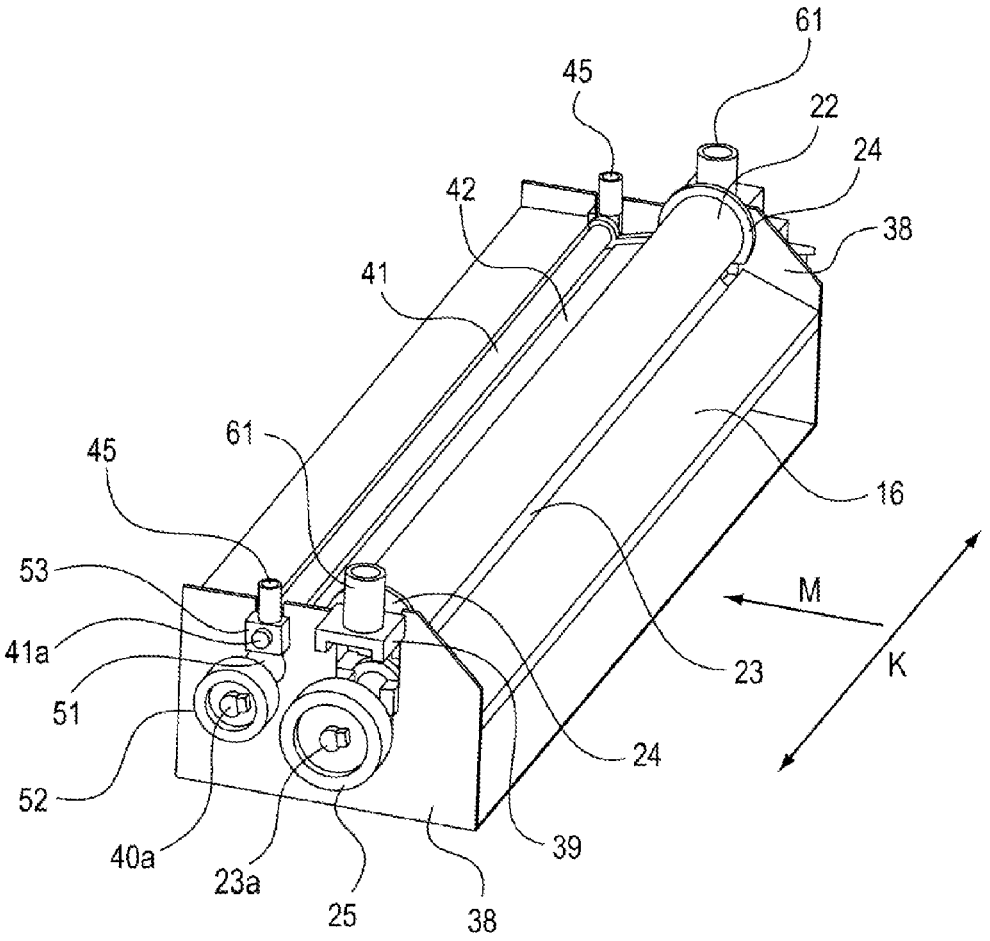
FIG. 2 is a perspective view of a fixing apparatus.

FIG. 2 is a perspective view of the fixing unit portion Fa and the curl correction portion Fb. The fixing unit portion Fa and the curl correction portion Fb have plates 38 that form a pair at a predetermined distance in a sheet width direction (a width direction K) orthogonal to the sheet conveying direction (a conveying direction M). A fixing sleeve 22 and a pressure roller 23 are attached to the pair of the plates 38 in a freely rotatable manner. Furthermore, on the upstream side in the sheet conveying direction M from the fixing sleeve 22 and the pressure roller 23, an inlet guide 16 is also provided to connect an inner wall surface of one plate 38 with an inner wall surface of the other plate 38. On the downstream side in the sheet conveying direction M from the fixing sleeve 22 and the pressure roller 23, an upstream upper guide 42 is disposed to connect an inner wall surface of one plate 38 with an inner wall surface of the other plate 38.

A gear 25 is attached to a shaft 23*a* of the pressure roller 23. A spring 61 applies a force to a bearing 39 of the fixing sleeve 22 toward the pressure roller 23. A gear 52 is attached to a shaft 40*a* of a soft roller (a second roller) 40 (see FIG. 3). A bearing 53 of the shaft 41*a* of a hard roller (a first roller) 41 is biased toward a bearing 51 of the soft roller 40 by a spring 45. The spring 45 applies a force to a bearing 53 of the shaft 41*a* of a hard roller (a first roller) 41 toward a bearing 51 of the soft roller 40 In addition, the spring 45 applies a force toward the soft roller 40, but a configuration in which the bearing of the hard roller 41 and the bearing of the soft roller 40 are fixed so as to approach each other may be provided. In any case, a positional relation in which the hard roller 41 bites into the soft roller 40 may be set.

Figure 3:
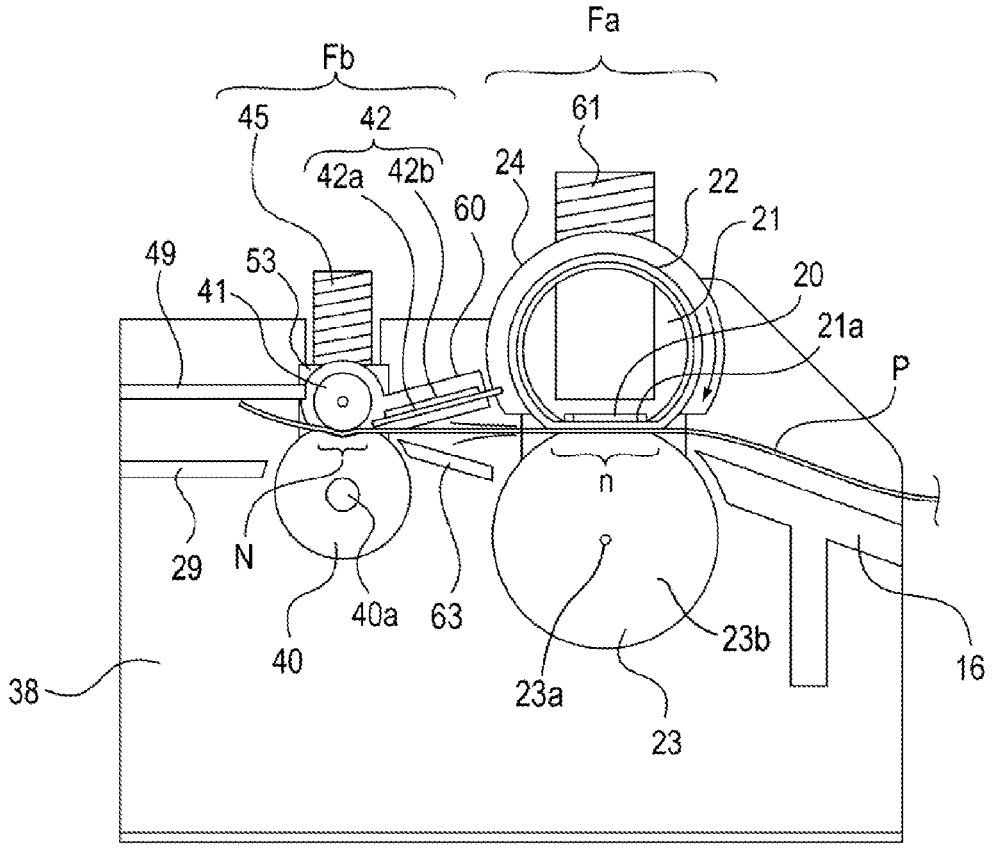
FIG. 3 is a cross-sectional view of the fixing apparatus.

FIG. 3 is a cross-sectional view of the fixing unit portion Fa and the curl correction portion Fb. As illustrated in FIG. 3, the fixing unit portion Fa is an on-demand fixing unit of a belt (a film) heating type and a pressure rotating member driving type (a tensionless type). The fixing unit portion Fa has the fixing sleeve 22 and the pressure roller 23. A fixing nip portion n is formed by the pressing between the fixing sleeve 22 and the pressure roller 23.

A fixing stay 21 formed in a trough shape having an arc-shaped side surface as viewed in a cross section and opened upward is disposed in the fixing sleeve 22. The fixing stay 21 has heat resistance and rigidity, holds the heater 20 on the bottom thereof, and guides the rotation of the fixing sleeve 22. A groove portion 21*a* is formed on the outer surface of the bottom surface of the fixing stay 21. The heater 20 is fitted into the groove portion 21*a*. Flanges 24 are each fitted to arm portions of both end portions in the longitudinal direction of the fixing stay 21, and come into contact with both end portions of the fixing sleeve 22 (see FIG. 2).

The fixing sleeve 22 is a composite layer structure in which an elastic layer, a toner parting layer or the like is added to the outer circumferential surface thereof by using a heat-resistant resin belt and a metal belt as a base layer, and is a member that is generally thin, and has flexibility, high thermal conductivity, and low thermal capacity.

The pressure roller 23 is a member in which hardness is lowered by providing an elastic layer 23*b* such as silicone rubber in the shaft 23*a* (a core). In order to improve the surface properties, a fluorine resin layer such as PTFE and PFA may be provided on the outer circumference thereof. The pressure roller 23 is configured so that both end portions of the shaft 23*a* are held between the plates 38 (frames) via the bearing 39 in a freely rotatable manner.

The pressure roller 23 and the fixing sleeve 22 are opposed to each other. The heater 20 is directed toward the pressure roller 23. The spring 61 applies the elastic force to the flanges 24 at both end portions of the fixing sleeve 22 to the pressure roller 23. The inlet guide 16 and the outlet lower guide 29 are assembled to the frame.

When the driving force of a motor (not illustrated) is transmitted to the gear 25 via a power transmission mechanism (see FIG. 2), the pressure roller 23 rotates in a counterclockwise direction. The rotational force of the pressure roller 23 is transmitted to the fixing sleeve 22 by the frictional force of the fixing nip portion n. The flanges 24 at both end portions of the fixing sleeve 22 prevent the fixing sleeve 22 from coming near one end portion or the other end portion in the longitudinal direction. Grease (lubricant) is applied to the inner surface of the fixing sleeve 22, and sliding properties of the fixing sleeve 22 with respect to the heater 20 and the fixing stay 21 are secured.

The curl correction portion Fb as a "curl correction apparatus" corrects the curl of the sheet P. The curl correction portion Fb has the hard roller 41, and the soft roller 40 pressed against the hard roller 41. The hard roller 41 is disposed in the downstream in the sheet conveying direction M of the fixing unit portion Fa as "fixing apparatus" configured to fix the toner image to the sheet P, and is formed of a hard material. For example, the hardness of the hard roller 41 may be set to 70° or more (when measured by Asker C). The soft roller 40 is disposed in the downstream in the sheet conveying direction M of the fixing unit portion Fa, is opposed to the hard roller 41, and is formed of a soft material having the hardness lower than the hard roller 41. For example, the hardness of the soft roller 40 may be set to 45° or less (when measured by Asker C). The hard roller 41 is formed of a metal such as iron. A toner adhesion preventing PTFA or PFA Tube is coated on the surface of the hard roller 41. The soft roller 40 is configured so that a sponge-like rubber such as foam silicone rubber is attached to the shaft 40*a* (the core) made of iron having a diameter of 8 mm. Here, the soft roller 40 is set to have a diameter of 18 mm and a rubber hardness of 25° (when measured by Asker C).

Furthermore, similarly to the hard roller 41, the soft roller 40 is also coated with a tube such as PTFA or PFA in order to prevent the toner adhesion to the surface. The hard roller 41 and the soft roller 40 are rotatably supported to the plate 38 via bearing 53 and 51, and the gear 52 attached to the end portion of the soft roller 40 is driven at a predetermined rotational speed by the driving force transmitted from the apparatus main body 100A.

The hard roller 41 is supported by the bearing 53 (see FIG. 2), and the spring 45 applies a force to the bearing 53 toward the soft roller 40. The applied force is set to a total pressure of 40N. With this configuration, the hard roller 41 is pressed against the soft roller 40 so as to bite therein, and the nip is formed.

The upstream upper guide 42 and the upstream upper guide 63 are provided in the upstream of the hard roller 41 and the soft roller 40. In particular, the upstream upper guide 42 as "the guide member" guides the fixed image surface of the sheet P by being disposed in the immediate upstream in the sheet conveying direction M with respect to hard roller 41. The downstream upper guide 49 and the outlet lower guide 29 are provided in the downstream of the hard roller 41 and the soft roller 40.

The upstream upper guide 42 is formed by bonding a metal plate 42*a* such as a thin stainless steel member having a thickness of approximately 0.3 mm and a metal plate 42*b* having a thickness of approximately 1 mm by welding. The metal plate such as a thin stainless steel material having the thickness of approximately 0.3 mm is used to bring the downstream end of the upstream upper guide 42 into contact with a nip portion formed from the hard roller 41 and the soft roller 40. The metal plate 42*b* having the thickness of approximately 1 mm is used to ensure the strength of the upstream upper guide 42 itself. Both end portions in longitudinal direction of the upstream upper guide 42 (a direction orthogonal to the sheet conveying direction) is further fixed to a guide holder 60, and the guide holder 60 is positioned coaxially with the hard roller 41. That is, the upstream upper guide 42 is accurately positioned with respect to hard roller 41.

Figure 4:
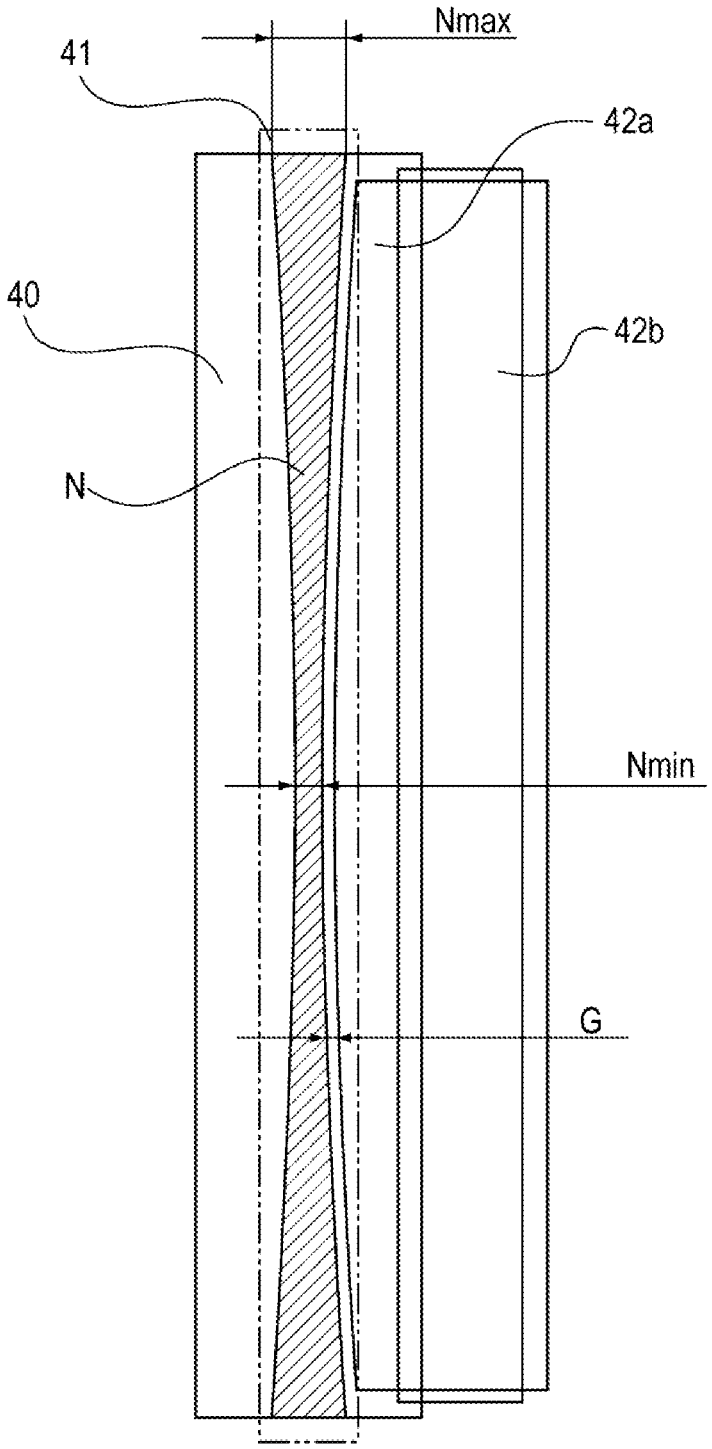
FIG. 4 is a cross-sectional view when a hard roller and a soft roller are viewed from the upper side.

FIG. 4 is a cross-sectional view when the hard roller 41 and the soft roller 40 are viewed from the upper side. The hard roller 41 is set to have a diameter of 8 mm, and a length of 330 mm. The soft roller 40 is set so that the shaft 40*a* has a diameter of 8 mm, and the entire roller has a diameter of 18 mm and a length of 330 mm. The hard roller 41 pressurizes the soft roller 40 with a pressure of 40N.

As described above, the spring 45 applies a force to the hard roller 41 to be bitten into the soft roller 40. The end portions of the hard roller 41 strongly bite into the soft roller 40 rather than the central portion thereof. For that reason, the nip width in the sheet conveying direction M of the nip portion N between the hard roller 41 and the soft roller 40 is set to be narrower in the central portion in the axial direction thereof than the both end portions in the axial direction thereof. A nip width N min of the central portion in the axial direction is set to approximately 3 mm, and a nip width N max of the end portion in the axial direction is set to approximately 5 mm. That is, in the nip portion N (a decal nip (a curl removal nip)) between the hard roller 41 and the soft roller 40, there is a difference of approximately 2 mm between the central portion and end portion in the axial direction.

Furthermore, the upstream upper guide 42 is configured to protrude in the central portion in the longitudinal direction to the downstream in the sheet conveying direction M from the both end portions in the longitudinal direction in a substantially arc shape. Specifically, the edge of the downstream of the upstream upper guide 42 maintains a gap G of approximately 1 mm so as not to come into contact with the hard roller 41, and has a convex arc shape (an arc shape having a radius of approximately 13000 mm) toward the downstream so as to proceed along the nip shape. In other words, the upstream upper guide 42 is configured so that the vicinity of the center thereof has a convex shape toward the downstream of approximately 1 mm from the end portion in the longitudinal direction. In addition, in FIG. 4, in order to facilitate understanding, the degree of the projection of the convex shape of the upstream upper guide 42 is exaggerated greater than actual measured values in the central portion and the end portion.

Figure 5A:
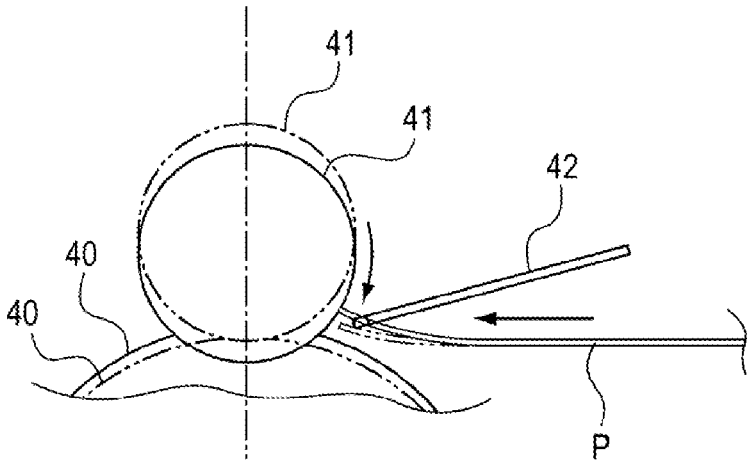
FIGS. 5A and 5B are a cross-sectional view and a perspective view illustrating a state in which the sheet curling upward is guided by an upstream upper guide, and proceeds toward the hard roller and the soft roller.
Figure 5B:
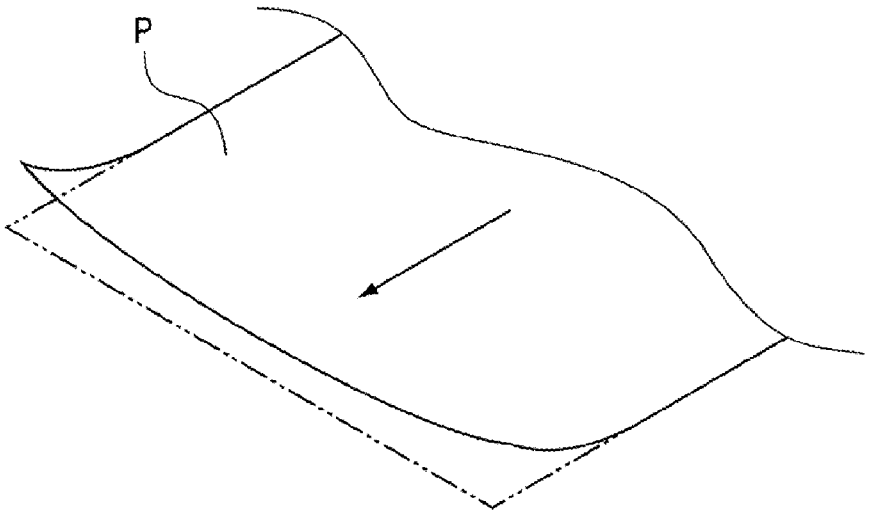

FIG. 5A is a cross-sectional view illustrating a state in which the sheet P with a leading end portion curled upward is guided by the upstream upper guide 42, and proceeds toward the hard roller 41 and the soft roller 40. In regard to the roller, a solid line represents a cross section of the end portion in the axial direction (the longitudinal direction) of the roller, and a two-dot chain line represents a cross section of the central portion in the axial direction (this point is also identical to FIGS. 6 and 7). In regard to the sheet P, a solid line represents a cross section of the end portion in the axial direction, and a two-dot chain line represents a cross section of the central portion in the axial direction (this point is also identical to FIGS. 6 and 7). FIG. 5B is a perspective view illustrating a state of the curl of the leading end of the sheet P. In addition, the axial direction, the longitudinal direction, and the width direction K are parallel to one another.

As illustrated in FIGS. 5A and 5B, the sheet P curled upward (hereinafter, referred to as an "upper curl") is guided by the upstream upper guide 42. First, the end portion of the sheet P abuts against the hard roller 41 beyond the downstream end of the upstream upper guide 42. Thereafter, the central portion in the width direction K of the sheet P approaches the hard roller 41 beyond the downstream end of the upstream upper guide 42. Since the downstream end of the upstream upper guide 42 is projected as in the embodiment, as compared to a case where the downstream end of the upstream upper guide 42 is formed linearly without being projected as in the prior art, the central portion in the width direction K of the sheet P is pressed until the central portion approaches the nip portion N between the hard roller 41 and the soft roller 40. In this state, both end portions in the width direction K of the sheet P are curled at a position higher than that of the central portion of the sheet P.

Figure 6A:
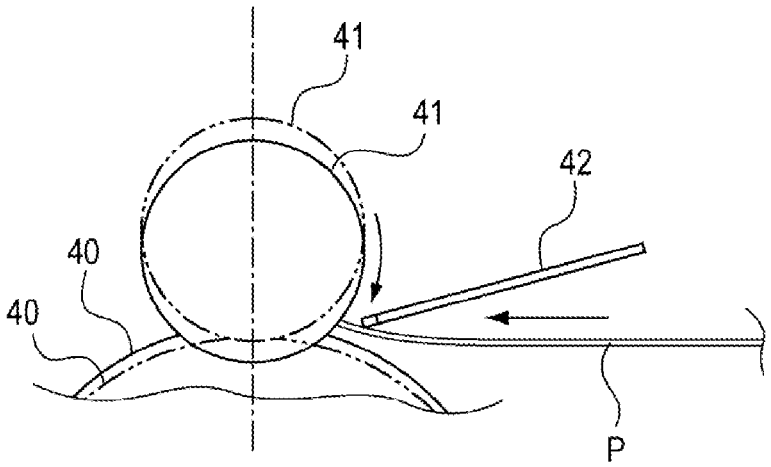
FIGS. 6A and 6B are a cross-sectional view and a perspective view illustrating continuations of FIGS. 5A and 5B.
Figure 6B:
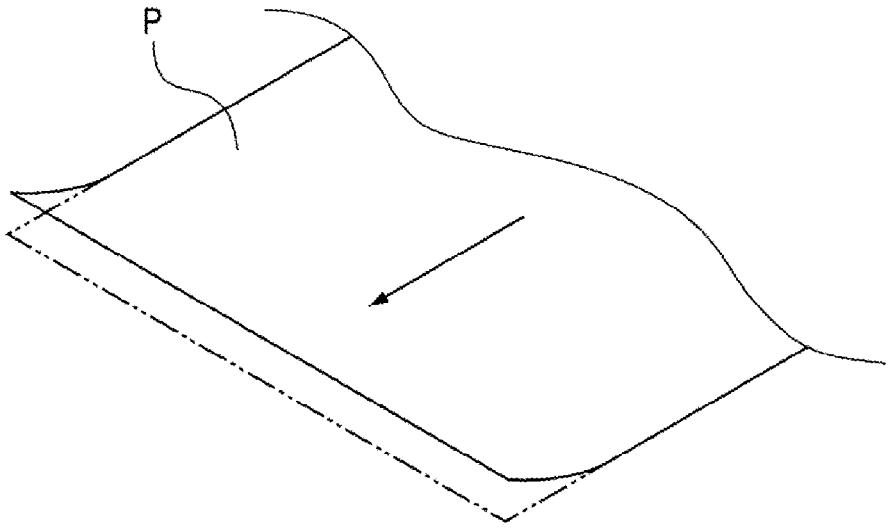

FIGS. 6A and 6B are a perspective view and a cross-sectional view illustrating the continuation of FIGS. 5A and 5B. As illustrated in FIGS. 6A and 6B, the end portion in the width direction K of the sheet P abuts against the hard roller 41, but at this time, the central portion in the width direction K of the sheet P does not abut against the hard roller 41 yet. However, the central portion in the width direction K of the sheet P approaches the hard roller 41, in a state in which the central portion comes near the nip portion N compared to a case of a configuration in which the downstream end of the upstream upper guide 42 has a linear shape. In this state, there is no difference in height in the width direction K between the end portion and the central portion in the width direction K of the sheet P.

Figure 7A:
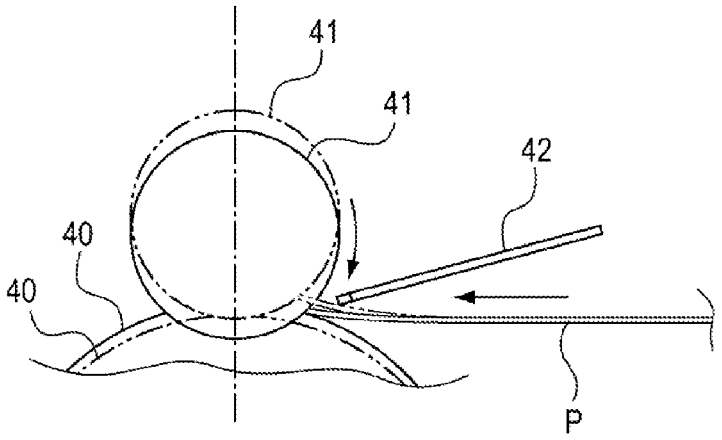
FIGS. 7A to 7C are a cross-sectional view and perspective views illustrating continuations of FIGS. 6A and 6B.
Figure 7B:
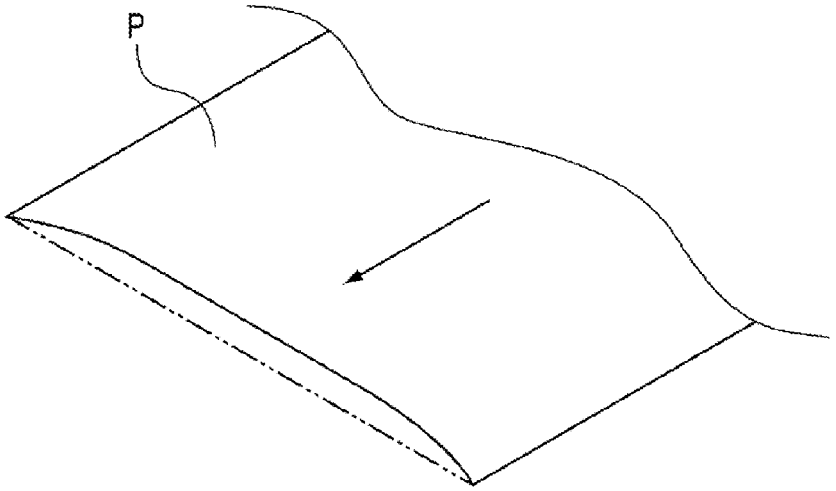

FIGS. 7A and 7B are a cross-sectional view and a perspective view illustrating the continuation of FIGS. 6A and 6B. As illustrated in FIGS. 7A and 7B, since the nip portion N has a medium narrow shape, the end portion of the sheet P slightly early enters the nip portion N, thereafter the central portion in the width direction K of the sheet P abuts against the hard roller 41 and rushes into the nip portion N. In this way, due to a configuration in which the central portion of the downstream end of the upstream upper guide 42 is projected toward the downstream, since the central portion in the width direction K of the sheet P is guided to a position close to the nip portion N, a phenomena in which a folding mark remains in the leading end or the sheet jams without entering the nip portion N is reduced. As a result, the sheet P smoothly rushes into the nip portion N, and the curl is corrected.

Figure 7C:
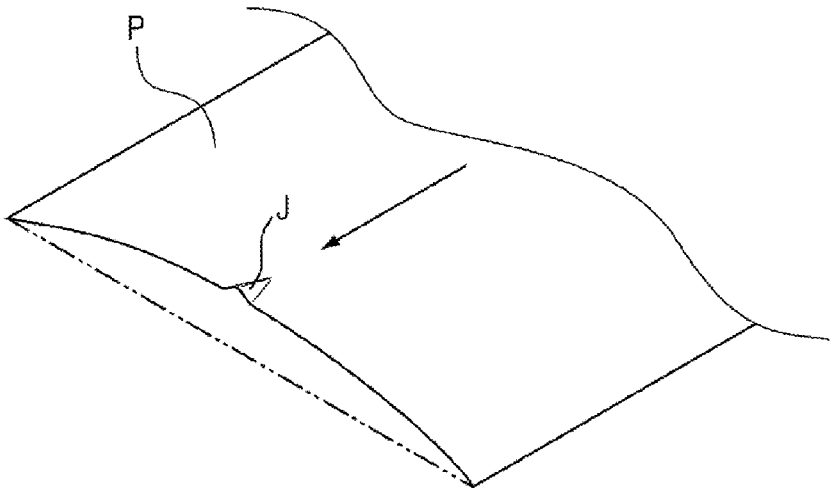

FIG. 7C is a perspective view illustrating what happens to the leading end of the sheet P when the sheet P is conveyed, in a case where the downstream end in the sheet conveying direction M of the upstream upper guide is formed in a linear shape. In a case where the downstream end of the upstream upper guide is formed in a straight line, in the leading end of the sheet P, the central portion in the width direction K comes into contact with the hard roller while curled upward from both end portions, due to bending of the hard roller. For that reason, since pressing due to the upstream upper guide is insufficient, before the central portion of the leading end of the sheet P enters the nip portion N, a bent portion J is formed.

Second Embodiment

Figure 8:
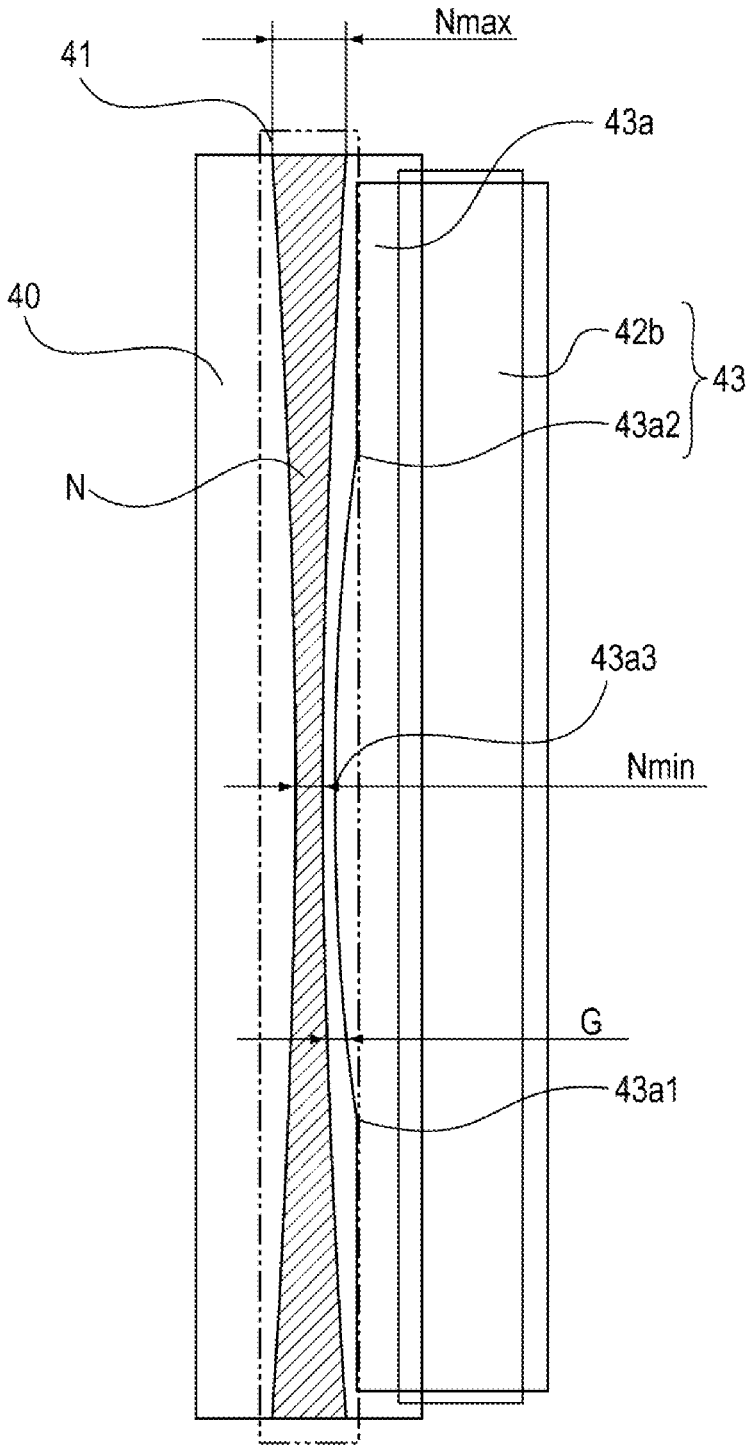
FIG. 8 is a cross-sectional view when a hard roller and a soft roller according to a second exemplary embodiment are viewed from the upper side.

FIG. 8 is a cross-sectional view when the hard roller 41, and the soft roller 40, and the upstream upper guide 43 according to a second embodiment are viewed from the upper side. The same configurations as the first embodiment are denoted by the same reference numerals, and the description thereof will not be provided. As illustrated in FIG. 8, the upstream upper guide 43 may be configured to protrude only in a predetermined range including a center 43*a*3 in the longitudinal direction toward the downstream in the sheet conveying direction M in a substantially arc shape. That is, the downstream end of the upstream upper guide 43 may be configured to protrude in a portion (a portion between arc start portions 43*a*1 and 43*a*2) of the center in the longitudinal direction toward the downstream in the sheet conveying direction M in an arc shape. The same effects as those of the first embodiment are obtained even in this case. In this regard, the second embodiment is different from the first embodiment in that the downstream end of the upstream upper guide 42 is configured to protrude in an arc shape toward the downstream in the sheet conveying direction M from the end portion to the central portion in the longitudinal direction. In addition, the upstream upper guide 43 is configured by bonding the metal plate 43*a* and the metal plate 43*b*.

Third Embodiment

Figure 9:
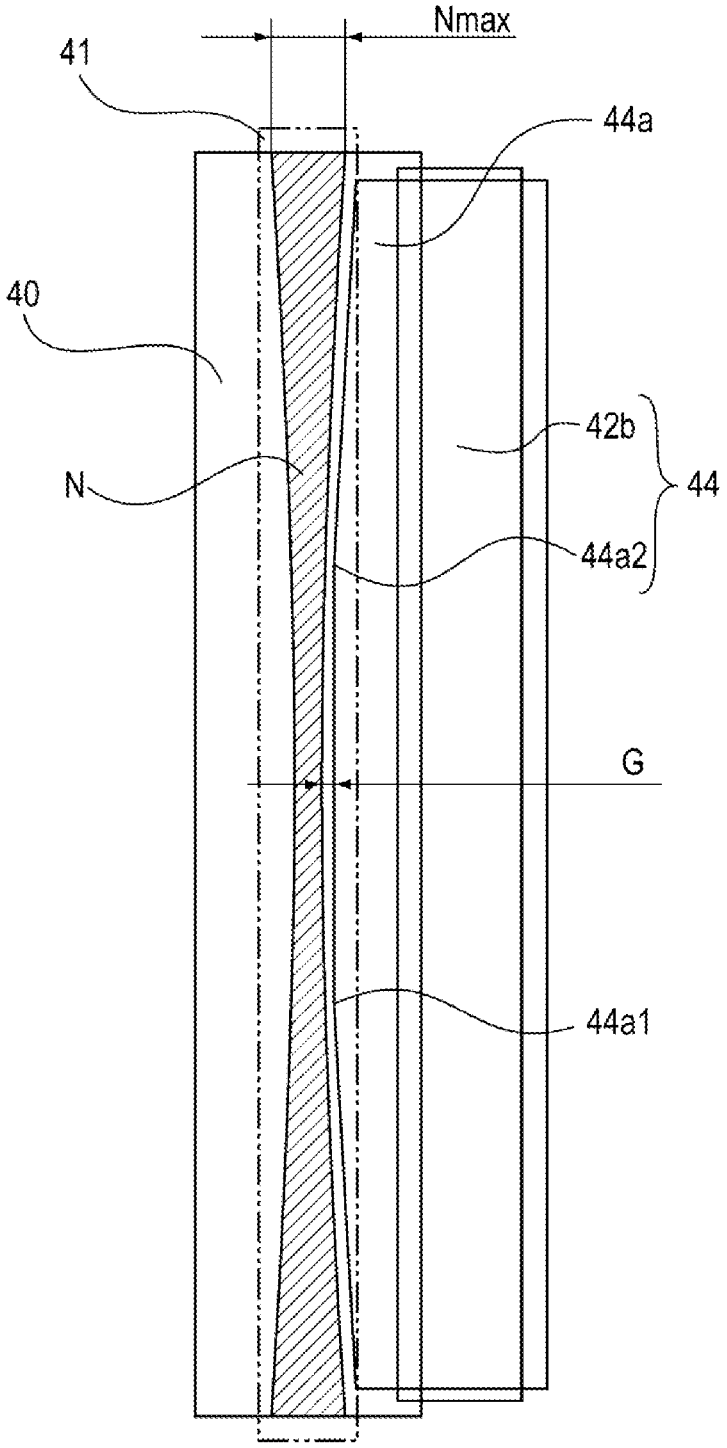
FIG. 9 is a cross-sectional view when a hard roller and a soft roller according to a third exemplary embodiment are viewed from the upper side.

FIG. 9 is a cross-sectional view when the hard roller 41, the soft roller 40, and the upstream upper guide 44 according to a third embodiment are viewed from the upper side. The same configurations as the first embodiment are denoted by the same reference numerals, and the description thereof will not be provided. As illustrated in FIG. 9, the upstream upper guide 44 may be configured to protrude toward the downstream side in the sheet conveying direction M in a trapezoidal shape. That is, the downstream end of the upstream upper guide 44 may be configured to protrude in a trapezoidal shape that is linearly inclined from the end portion in the longitudinal direction to corners 44*a*1, and 44*a*2 positioned at the central portion, and extend from the corners 44*a*1, and 44*a*2 to the central portion in the width direction K. In addition, the upstream upper guide 44 is configured by bonding the metal plate 44*a* and the metal plate 44*b*.

According to the configuration of the embodiment, in the configuration which includes the hard roller 41 and the soft roller 40 configured to correct the curl in the immediate downstream in the sheet conveying direction M with respect to the fixing unit portion Fa (the fixing apparatus), unevenness that may occur in the sheet P in the width direction K orthogonal to the sheet conveying direction M is reduced.

In addition, in the first to third embodiments, the soft roller 40 made of a foam silicone rubber or the like is used in the curl correction apparatus, but may not be limited to this embodiment. That is, instead of the soft roller, a belt may be used in the curl correction apparatus, and the same effect can be obtained according to the configuration in which the downstream end projects as in the upstream upper guides 42 to 44.

Furthermore, in the first to third embodiments, a belt heating type, and a pressing rotating member driving type are adopted in the fixing unit portion Fa, but may not be limited to this embodiment. That is, a heat roller type, an electromagnetic induction heating type, and other types may be adopted.

Furthermore, in the first to third embodiments, the fixing unit portion Fa configured to fix the toner image onto the sheet P was described, but the invention may be applied to the heating apparatus that increases the gloss of an image by heating the image fixed onto the sheet P.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2013-022529, filed Feb. 7, 2013, which is hereby incorporated by reference herein in its entirety.

What is claimed is:

1. A curl correction apparatus disposed downstream in a sheet conveying direction with respect to a fixing unit which fixes a toner image onto a sheet, the apparatus for correcting a curl of the sheet, the apparatus comprising:

a first roller;

a second roller having a hardness lower than that of the first roller, the first roller and the second roller forming a nip portion;

an urging member configured to urge the first roller to the second roller;

a guide member configured to guide the sheet onto which the toner image is fixed by the fixing unit to the nip portion, the guide member being disposed on an upstream side of the nip portion in the sheet conveying direction, wherein a length of the nip portion in the sheet conveying direction at a longitudinal central portion of the nip portion is shorter than a length of the nip portion in the sheet conveying direction at two longitudinal end portions of the nip portion, wherein a downstream edge of the guide member in the sheet conveying direction at a longitudinal central portion of the guide member protrudes further in the sheet conveying direction than a downstream edge of the guide member in the sheet conveying direction at the two longitudinal end portions of the guide member, and wherein the guide member is positioned such that the downstream edge of the guide member at the longitudinal central portion of the guide member overlaps with the first roller in the conveying direction when the first roller and the guide member are viewed in an urging direction of the urging member.

2. The curl correction apparatus according to claim 1, wherein the downstream edge of the guide member protrudes in the sheet conveying direction in a substantially arc shape.

3. The curl correction apparatus according to claim 1, wherein the guide member is configured to protrude only in a predetermined range including the center in the axial direction toward the downstream in the sheet conveying direction in the substantially arc shape.

4. The curl correction apparatus according to claim 1, wherein the guide member protrudes toward the downstream in the sheet conveying direction in a trapezoidal shape.

5. The curl correction apparatus according to claim 1, wherein the guide member includes a metal member, and wherein the metal member guides the sheet.

6. The curl correction apparatus according to claim 5, wherein the metal member is attached to a holder.

7. The curl correction apparatus according to claim 5, wherein the metal member includes a first metal member and a second metal member attached to the first metal member, wherein a thickness of the first metal member is bigger than that of the second metal member, and wherein the second metal member guides the sheet.

8. The curl correction apparatus according to claim 1, wherein an outer diameter of the first roller is smaller than an outer diameter of the second roller.

9. The curl correction apparatus according to claim 1, wherein the guide member contacts a first surface of the sheet and does not contacts a second surface of the sheet, and wherein the first surface is a surface onto which the toner image is fixed by the fixing unit, and the second surface is a surface which is opposite to the first surface.

10. A sheet conveying apparatus comprising:

a first roller;

a second roller having a hardness lower than that of the first roller, the first roller and the second roller forming a nip portion;

an urging member configured to urge the first roller to the second roller; and a guide member configured to guide the sheet to the nip portion, the guide member being disposed on an upstream side of the nip portion in the sheet conveying direction, wherein a length of the nip portion in the sheet conveying direction at a longitudinal central portion of the nip portion is shorter than a length of the nip portion in the sheet conveying direction at two longitudinal end portions of the nip portion, wherein a downstream edge in the sheet conveying direction of the guide member at a longitudinal central portion of the guide member protrudes further in the sheet conveying direction than a downstream edge of the guide member at the two longitudinal end portions of the guide member, and wherein the guide member is positioned such that the downstream edge in the sheet conveying direction of the guide member at the longitudinal central portion of the guide member overlaps with the first roller in the conveying direction when the first roller and the guide member are viewed in an urging direction of the urging member.

11. The sheet conveying apparatus according to claim 10, wherein the curl of the sheet is corrected by conveying the sheet while the sheet is interposed between the first roller and the second roller.

12. The sheet conveying apparatus according to claim 10, wherein the downstream edge of the guide member protrudes in the sheet conveying direction in a substantially arc shape.

13. The sheet conveying apparatus according to claim 10, wherein the guide member is configured to protrude only in a predetermined range including the center in the axial direction to the downstream side in the sheet conveying direction in the substantially arc shape.

14. The sheet conveying apparatus according to claim 10, wherein the guide member protrudes to the downstream side in the sheet conveying direction in a trapezoidal shape.

15. The sheet conveying apparatus according to claim 10, wherein the guide member includes a metal member, and wherein the metal member guides the sheet.

16. The sheet conveying apparatus according to claim 15, wherein the metal member is attached to a holder.

17. The sheet conveying apparatus according to claim 15, wherein the metal member includes a first metal member and a second metal member attached to the first metal member, wherein a thickness of the first metal member is larger than a thickness of the second metal member, and wherein the second metal member guides the sheet.

18. The sheet conveying apparatus according to claim 10, wherein an outer diameter of the first roller is smaller than an outer diameter of the second roller.

19. The sheet conveying apparatus according to claim 10, wherein the guide member contacts a first surface of the sheet and does not contact a second surface of the sheet.

20. An image forming apparatus for forming an image on a sheet, comprising:

an image forming portion for forming an image on the sheet;

a fixing portion configured to fix the image on the sheet at a fixing nip portion while conveying and heating the sheet on which the image is formed;

a correction portion, disposed on a downstream side of the fixing nip portion in a sheet conveyance direction, configured to correct a curl of the sheet while conveying the sheet at a correcting nip portion, the correction portion including a first roller, a second roller which has a hardness lower than the first roller and which forms the correcting nip portion with the first roller, and an urging member which urges the first roller to the second roller; and a guide member, disposed between the fixing nip portion and the correcting nip portion in the sheet conveyance direction, configured to guide the sheet to the correcting nip portion, a downstream edge of the guide member in the sheet conveyance direction at a longitudinal central portion of the guide member protrudes further in the sheet conveyance direction than a downstream edge of the guide member in the sheet conveyance direction at two longitudinal end portions of the guide member, wherein a length of the nip portion in the sheet conveying direction at a longitudinal central portion of the nip portion is shorter than a length of the nip portion in the sheet conveying direction at the two longitudinal end portions of the nip portion.

21. The image forming apparatus according to claim 20, wherein the guide member is positioned such that the downstream edge of the guide member at the longitudinal central portion of the guide member overlaps with the first roller when the first roller and the guide member area viewed in an urging direction of the urging member.

22. The image forming apparatus according to claim 20, wherein the fixing portion includes a heating member and a back-up member forming the fixing nip portion, and wherein the guide member is positioned at the same side as the heating member with respect to the sheet.

* * * * *